United States Patent [19]

Suzuki et al.

[11] 4,327,899

[45] May 4, 1982

[54] STAVE COOLING DEVICE HAVING UNWELDED DOUBLE TUBE

[75] Inventors: Gyoichi Suzuki, Tokyo; Teruo Shimotsuma, Yokohama; Masaaki Higuchi, Yokohama; Tsunenori Sugawara, Yokohama; Takeshi Yano, Yokohama, all of Japan

[73] Assignee: Nippon Kokan Kabushiki Kaisha, Tokyo, Japan

[21] Appl. No.: 136,755

[22] Filed: Apr. 3, 1980

[30] Foreign Application Priority Data

Apr. 9, 1979 [JP] Japan ..... 54/33726

[51] Int. Cl.[3] ..... C21B 7/10

[52] U.S. Cl. ..... 266/193; 165/70

[58] Field of Search ..... 266/193, 197, 137; 165/70, 171, 180, 168, 134, 81

[56] References Cited

U.S. PATENT DOCUMENTS

| | | | |
|---|---|---|---|
| 1,090,574 | 3/1904 | Shannon | 266/193 |
| 2,743,089 | 4/1956 | Gardnier | 165/70 |
| 3,706,343 | 12/1972 | Saiga | 266/193 |
| 4,150,818 | 4/1979 | Buhler | 266/193 |
| 4,162,061 | 7/1979 | Buhler | 266/193 |
| 4,217,954 | 8/1980 | Vincent | 266/193 |

*Primary Examiner*—P.D. Rosenberg

*Attorney, Agent, or Firm*—Fleit & Jacobson

[57] ABSTRACT

A stave cooling device includes a double drawn steel tube cast-mounted in a castable metal main body, and the double tube includes an inner tube which serves as a passage for a coolant. The inner tube of the double tube contains 0.20 to 0.38% of equivalent carbon and an outer tube of the double tube contains 0.15 to 0.25% of equivalent carbon. The outer tube has on its outer surface an alumina coating of 0.08 to 0.25 mm thick, and the main body is formed by casting a spheroidal graphite cast iron. The double tube is cast-mounted in the main body such that the double tube and the main body are not welded together.

4 Claims, 4 Drawing Figures

STAVE COOLING DEVICE HAVING UNWELDED DOUBLE TUBE

BACKGROUND OF THE INVENTION

The present invention relates to improvement in stave cooling devices for metallurgical furnaces such as blast furnaces, and more particularly the invention relates to an improved stave cooling device so designed that a crack produced in the stave main body by the heat load from a furnace is prevented from extending to the cooling tube portion and causing a total failure of the device.

Generally, the hearth walls of a metallurgical furnace such as a blast furnace are constructed of refractory bricks and suitable cooling boxes are installed everywhere through the outer shell. However, as the result of the recent trend toward larger blast furnaces, the heat capacity of hearth has been increased very greatly and the cooling capacity of the cooling boxes has been found insufficient for the purpose. Thus, practically all of the recently installed blast furnaces are equipped with stave cooling devices. As regards the utility of such stave cooling device, on the one hand the device must of course be excellent in heat resisting and abrasion resisting properties and capable of firmly sustaining the hearth wall over a long period of time, and on the other hand the device must meet the optimum conditions with respect to the effective heat exchange at the hearth-side heat receiving surface of the stave, the heat transfer efficiency between the internal cooling pipe line and the stave main body, the prevention of a crack produced in the stave main body from extending to the cooling pipe line and so on and its manufacturing process must also be simple.

Stave cooling devices proposed in the past include a so-called unwelded type in which the cooling tube is of the single-tube type and the tube and the stave main body are not welded together, a double-tube welded type, etc., and the method for preventing the cooling tube and the stave main body from being welded together mostly consists of applying a non-metallic coating to the surface of the cooling tube and then cast-mounting the cooling tube in the stave main body.

However, the stave cooling devices which have heretofore been put in practice and used are disadvantageous in that they are incapable of giving a full play to their valuable utility due to the inferior efficiency of heat transfer between the cooling tube and the stave main body with the resulting melting loss of the main body and due to the fact that a crack produced in the stave main body tends to extend to the cooling tube due to an insufficient welding preventing treatment and so on.

SUMMARY OF THE INVENTION

With a view to overcoming the foregoing deficiencies of the prior art stave cooling devices, it is the object of the present invention to provide an improved stave cooling device which is excellent in heat resisting and abrasion resisting properties and capable of firmly sustaining the hearth wall over a long period of time.

In accordance with the present invention, there is thus provided a stave cooling device in which a castable metal main body is casted such that a double drawn steel tube is mounted in the cast main body and an inner tube of the double tube functions as a coolant passage. The inner tube of the double tube contains 0.20 to 0.38% of equivalent carbon and the outer tube contains 0.15 to 0.25% of equivalent carbon. An alumina coating of 0.08 to 0.25 mm thick is applied to the outer surface of the outer tube and the main body is formed by casting a spheroidal graphite cast iron such that the double tube is mounted in the main body without the two being welded together.

Each of the inner and outer tubes is a steel tube and the content Ceg (%) of the equivalent carbon in its composition is given in terms of the following equation $$Ceg\ (\%) = C + \frac{1}{6}Mn + \frac{1}{24}Si + \frac{1}{40}Ni + \frac{1}{5}Cr + \frac{1}{4}Mo + \frac{1}{13}Cu + \frac{1}{2}P$$

With the stave cooling device having an unwelded double cooling tube according to the invention, the heat flow around the cooling tube can be approximated in terms of the heat transmission of a one-dimensional cylinder and thus by setting the coefficient of overall heat transmission of the cooling tube to a proper value in accordance with the cooling conditions, tube diameter, etc., it is possible to realize the device without any loss of cooling capacity. As a result, it is possible to provide a stave cooling device having a sufficient cooling capacity, in which even if a crack is produced in the stave main body by a thermal shock or any other cause, the crack is prevented from extending to the cooling tube by means of the unwelded alumina coating. Moreover, if the unwelded coating of the tube is defective by any chance so that a weld is formed between the casting or the stave main body and the outer tube and the crack is allowed to extend to the outer tube, the crack is prevented from extending to the inner tube due to the fact that the inner and outer tubes are not welded together. As a natural consequence, this has the effect of doubly ensuring safety against leakage of the coolant and also ensuring the heat transfer resistance between the casting or the stave main body, the cooling tube and the coolant by means of the stave cooling device with the resulting increase in the life of the furnace body.

It should be noted that the blast furnace equipped with the stave cooling devices produced according to the teachings of this invention has been in service for the past three years without giving rise to any difficulty, thus proving that the stave cooling devices have greatly contributed toward stable operation of the blast furnace. Of course, the stave cooling device according to the invention can be used not only in blast furnaces but also in other furnaces as a cooling block with a cast-in cooling tube.

The present invention will become more apparent from the following description of the preferred embodiments thereof taken in conjunction with the accompanying drawings.

DESCRIPTION OF THE PREFERRED EMBODIMENTS

Figure 1:
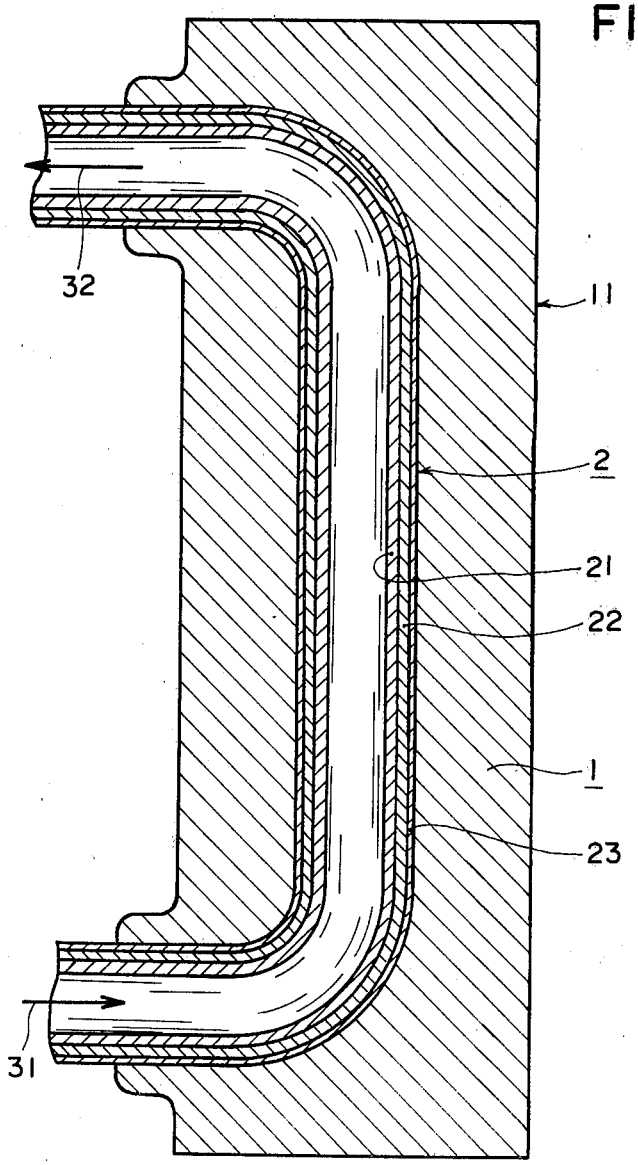
FIG. 1 is a longitudinal sectional view showing an embodiment of the invention.

Generally, a cooling stave comprises a main body cast from a castable metal and a cooling tube mounted as an integral part in the cast main body. Also in accordance with the present invention, as shown in FIG. 1, a cooling stave comprises a cooling tube 2 mounted as an integral part in a cast main body 1. The cooling tube 2 is a double drawn steel tube comprising an inner steel tube 21 and an outer steel tube 22, and an alumina coating 23 is applied to the outer surface of the outer tube 22. The main body 1 is cast from a spheroidal grahpite cast iron, and the main body 1 and the double tube 2 mounted therein are not welded together due to the presence of the alumina coating 23. The inner tube 21 is made of a steel having a composition containing 0.20 to 0.38% of equivalent carbon, and the outer tube 22 is made of a steel having a composition containing 0.15 to 0.25% of equivalent carbon. The thickness of the alumina coating 23 has a value in the range of 0.08 to 0.25 mm. Arrows 31 and 32 indicate the direction of flow of the coolant which is used while the blast furnace is in operation, and the heat received by a heat receiving surface 11 of the main body 1 is released to the outside.

The stave cooling device according to the present invention is constructed as described above on the following ground. According to the classification of the stave cooling devices, the stave cooling device of this invention belongs in the category of double cooling tube type in which the stave main body and the double cooling tube outer surface are not welded together, and a feature of this invention resides in that different materials are used for the inner and outer tubes of the double tube from the standpoint of pressure bonding of the inner and outer tubes of the double tube and from the standpoint of preventing deterioration of the materials due to their carburization by the main body at elevated temperatures. More specifically, a steel of a composition having an equivalent carbon value of 0.20 to 0.38%, preferably 0.23 to 0.35% as calculated in terms of an equation $$Ceg\,(\%) = C + \frac{1}{6}Mn + \frac{1}{24}Si + \frac{1}{40}Ni + \frac{1}{5}Cr + \frac{1}{4}Mo + \frac{1}{13}Cu + \frac{1}{2}P$$

is used for the inner tube and a steel of a composition containing 0.15 to 0.25%, preferably 0.17 to 0.20% of equivalent carbon as calculated in terms of the same equation is used for the outer tube. The inner and outer tubes are then formed into a double tube and drawn by cold drawing or the like into a double drawn tube having an increased degree of bonding between the inner and outer tubes. This fact may be explained from a different point of view as follows. The tensile strength of the inner tube must be 40 Kg/mm$^2$ or over so that the essential role or the cooling function of the stave cooling device can be performed satisfactorily even if a crack is produced in the stave main body or the casted body and even if the crack is extended to the outer tube causing a crack or other damage thereto. On the other hand, the outer tube must be made of a soft material in consideration of the operating efficiency of cold drawing or the like used for producing the double tube and from the standpoint of eliminating any difficulty even if the alumina coating includes a defective portion or a thin portion (that is almost unlikely to occur) so that such a defective portion is carburized by the casted body or the stave main body. For these reasons, the equivalent carbon in the steel compositions of the inner and outer tubes are defined as mentioned previously.

The following Tables 1a and 1b show by way of example the chemical compositions and mechanical properties of preferred steel materials for the inner and outer tubes according to the invention.

TABLE 1a

| | | Chemical Composition (%) | | | | | |
|---|---|---|---|---|---|---|---|
| Tube | Grade | C | Si | Mn | P | S | Cu |
| Inner tube | STPT-42 | 0.17 -0.22 | 0.10 -0.35 | 0.30 -0.60 | 0.010 -0.02 | 0.010 -0.02 | 0.05 or less |
| Outer tube | MSKL STB-35 | 0.09 -0.11 | 0.18 -0.21 | 0.41 -0.44 | 0.018 -0.013 | 0.013 -0.019 | 0.03 or less |

TABLE 1b

| | | Mechanical Properties | | |
|---|---|---|---|---|
| Tube | Equivalent carbon (%) | Tensile strength (Kg/mm$^2$) | Yield point (Kg/mm$^2$) | Elongation (%) |
| Inner tube | 0.23-0.35 | 44-46 | 25-33 | 60-65 |
| Outer tube | 0.17-0.20 | 36-42 | 24-30 | 62-70 |

The equivalent carbon of the outer tube is limited to the above-mentioned range so as to prevent any possible carburization of the outer tube in view of the fact that the alumina coating deposited by the spraying process on the outer surface of the outer tube is as thin as 0.08 to 0.25 mm so as to improve the heat transfer efficiency. The use of a material containing a greater amount of equivalent carbon than the above-mentioned range is not desirable in view of the possible embrittlement of the tube due to carburization, and a material containing a smaller amount of equivalent carbon than the above-mentioned range has the disadvantage of being excessively low in strength. The equivalent carbon of the inner tube is limited to the above-mentioned range on the following ground. Although the inner tube is pressure bonded to the outer tube physically, the two tubes are quite different from each other metallographically. As a result, the inner tube must have a sufficient strength so that even if a crack is produced in the stave main body, the extension of the crack is prevented by the unwelded alumina coating and even if the crack is extended to the outer tube, the crack is prevented from extending further by the inner tube. Of course, the range of equivalent carbon in the steel materials for the inner and outer tubes are also selected for the purpose of ensuring the proper combination of strengths that would avoid any difficulty from the standpoint of workability in for example the drawing operation for the production of a double tube in addition to the above-mentioned consideration of the prevention of carburization and the desired strength.

The following Tables 2a and 2b show by way of example the chemical composition and mechanical properties of spheroidal graphite cast iron used for the stave main body according to the invention.

TABLE 2a

| Chemical Composition (%) | | | | | |
|---|---|---|---|---|---|
| C | Si | Mn | P | S | Cr |
| 3.62 | 2.20 | 0.14 | 0.046 | 0.0006 | 0.03 |

TABLE 2b

| Mechanical Properties | | | |
|---|---|---|---|
| Yield point ($Kg/mm^2$) | Tensile strength ($Kg/mm^2$) | Elongation (%) | Reduction of area (%) |
| 29.2 | 41.9 | 23.6 | 26.4 |

Figure 2:
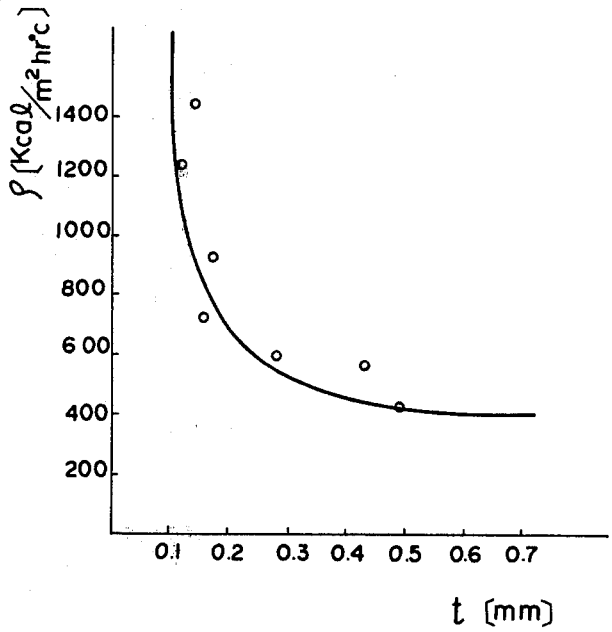
FIG. 2 is a graph showing the relationship between the heat transfer rate $\rho$ (ordinate) between the cooling tube and the main body and the thickness t (abscissa) of the alumina coating.

Another feature of the present invention resides in that the thickness of the unwelded alumina coating applied to the outer surface of the double cooling tube is limited to the optimum range. As already mentioned in connection with the description of the prior art at the beginning, it is well known in the art to perform a surface treatment so as to form a unwelded coating of clay, alumina, zirconia or the like on the outer surface of cooling metal tubes. In accordance with the present invention, the material and thickness of the coating forming the unwelded coating constituent very important requirements along with the selection of steel materials for the double drawn cooling tube. Thus, in accordance with the invention, the alumina spraying process is used as a means of forming the desired unwelded coating and its thickness is limited to the range of 0.08 to 0.25 mm. The alumina spraying process is used because of its ability to reduce the thickness of a coating and its improved heat transfer efficiency over other materials, and the upper limit of the coating thickness is set to 0.25 mm since any greater thickness will result in an insufficient heat exchange giving rise to the danger of causing such trouble as melting loss of the stave main body. On the other hand, if the thickness is less than 0.08 mm, although the heat transfer efficiency is improved, there is the danger of causing carburization of the outer tube with the resulting danger of causing embrittlement of the outer tube and eventually causing any detrimental effect on the inner tube. FIG. 2 is a graph showing the relationship between the thickness t of the sprayed alumina coating and the heat transfer rate $\Sigma$ between the cooling tube and the casting of the stave main body. As will be seen from the Figure, there is an inversely proportional relation between the thickness of the alumina coating and the heat transfer rate between the cooling tube and the casting and it will be seen that the heat transfer rate rapidly changes with the coating thickness between 0.1 and 0.2 mm providing the necessity of limiting from this point of view the thickness of the alumina coating according to the invention.

The following Tables 3a and 3b show the chemical compositions and mechanical properties of preferred examples of the double cooling tube according to the invention.

TABLE 3a

| | | Chemical Composition (%) | | | | | |
|---|---|---|---|---|---|---|---|
| Tube | Grade | C | Si | Mn | P | S | Cu |
| Inner tube | STPT-42 | 0.20 | 0.20 | 0.45 | 0.015 | 0.016 | 0.04 |
| Outer tube | SMKL STB-35 | 0.10 | 0.19 | 0.42 | 0.011 | 0.011 | 0.03 |

TABLE 3b

| | | Mechanical Properties | | |
|---|---|---|---|---|
| Tube | Equivalent carbon | Tensile strength ($Kg/mm^2$) | Yield point ($Kg/mm^2$) | Elongation (%) |
| Inner tube | 0.294 | 45 | 31 | 63 |
| Outer tube | 0.186 | 40 | 28 | 68 |

The above-mentioned inner and outer tubes were formed by cold drawing into a double tube to increase the degree of bonding between the inner and outer tubes and an alumina coating of 0.14 mm thick was applied by the alumina spraying process onto the outer surface of the double cooling tube. Then the double cooling tube was cast-mounted in the spheroidal graphite cast iron main body forming a cooling stave of the ordinary shape. In this case, the casting temperature was in the range of 1245°±15° C. in consideration of the small thickness of the alumina coating. If the casting temperature was lower than this range, the gap between the tube and the main body would be increased with the resulting decrease in the heat transfer rate. If the casting temperature was higher than the range, the alumina coating would be fused causing the tube and the main body to tend to be welded together and thereby giving rise to the danger of carburization. It should be noted that when a double tube was produced by using a black skin inner tube, forming the inner and outer tubes into a double tube by cold drawing and then cast-mounting the tube in the main body, the resulting heat transfer rate was 2000 $Kcal/m^2hr°$ C. When a pickled inner tube was used to produce a double tube by cold drawing and the tube was cast-mounted in the main body, the resulting heat transfer rate was 5000 $Kcal/m^2hr°$ C. Thus, a pickled inner tube should of course be used.

Figure 3B:
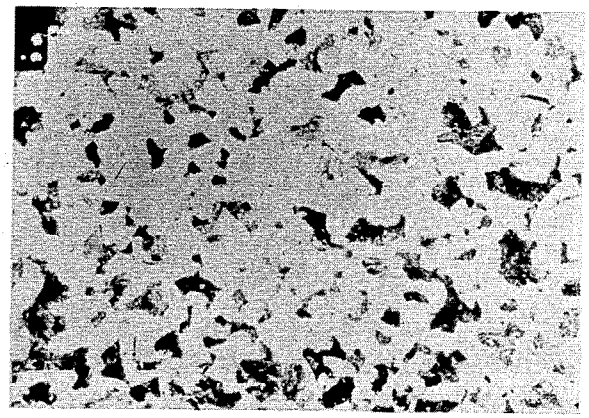
FIGS. 3*a* to 3*d* are microphotographs (magnification: 100×) showing the steel structure at the section of the outer tubes to confirm the presence of carburization in the outer tubes with alumina coatings of different thicknesses.
Figure 3D:
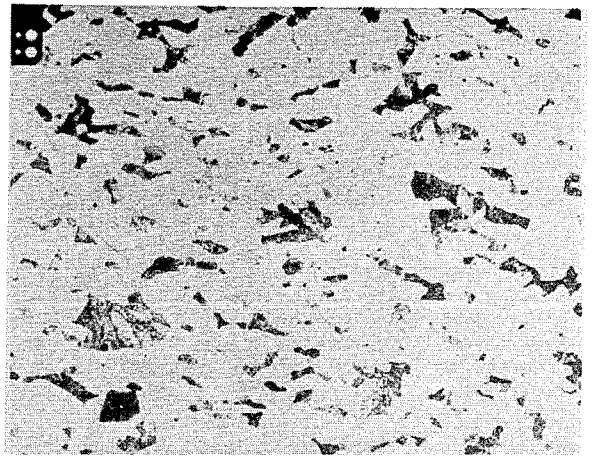
Figure 3A:
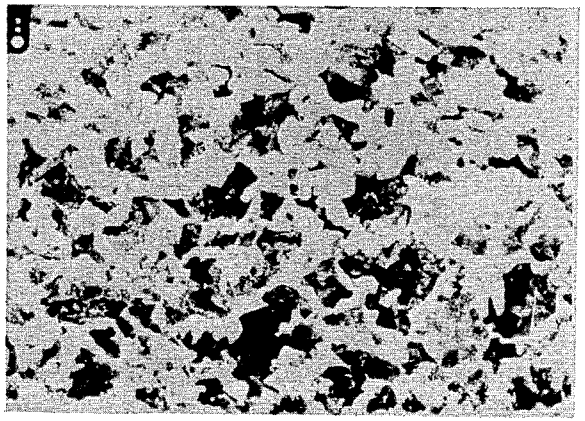
Figure 3C:
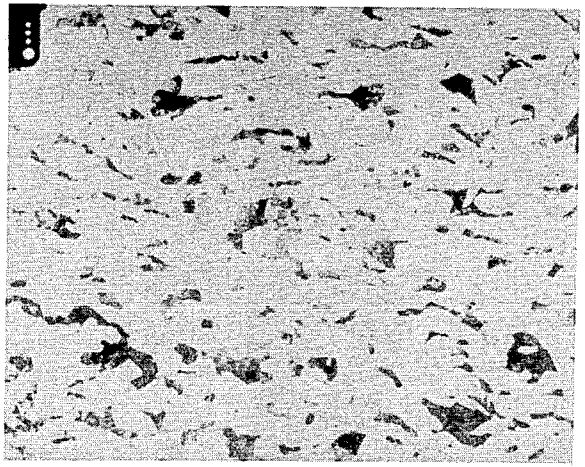

FIG. 3*a* is a microphotograph (magnification: 100×) showing the sectional steel structure in the outer surface of an outer tube having an alumina coating of 0.05 mm thick, and FIG. 3*b* is the similar microphotograph of an outer tube having an alumina coating of 0.14 mm thick. FIG. 3*c* is a microphotograph (magnification: 100×) showing the sectional steel structure in the wall center portion of the outer tube having the alumina coating of 0.05 mm, and FIG. 3*d* is the similar microphotograph of the outer tube having the alumina coating of 0.14 mm thick. It will be seen from FIGS. 3*a* and 3*c* that the outer surface of the outer tube having the alumina coating of 0.05 mm thick was carburized, and FIGS. 3*b* and 3*d* show that there was no carburization in the outer tube of this invention having the alumina coating of 0.14 mm thick.

What is claimed is:

1. In a stave cooling device having a cooling tube cast-mounted in a main body of a castable metal such that said cooling tube and said main body are not welded together, and said cooling tube serves as a coolant passage, the improvement wherein said cooling tube comprises a double drawn steel tube including an inner tube made of a steel having a composition containing 0.20 to 0.38% of equivalent carbon and an outer tube made of a steel having a composition containing 0.15 to 0.25% of equivalent carbon, wherein an outer surface of said double tube is covered with an alumina coating having a thickness between 0.08 and 0.25 mm, and wherein said alumina coated double tube is cast-mounted in said main body made of a spheroidal graphite cast iron such that said double tube and said main body are not welded together, and ends of said double tube are extended to the outside of said main body.

2. A stave cooling device according to claim 1, wherein said equivalent carbon of said inner tube is between 0.23 and 0.35%, and wherein said equivalent carbon of said outer tube is between 0.17 and 0.20%.

3. A stave cooling device according to claim 1, wherein said inner tube is made of a steel having a composition containing C: 0.17–0.22%, Si: 0.10–0.35%, Mn: 0.30–0.60%, P: 0.010–0.02%, S: 0.010–0.02% and Cu: 0.05% or less, wherein said outer tube is made of a steel having a composition containing C: 0.09–0.11%, Si: 0.18–0.21%, Mn: 0.41–0.44%, P: 0.018–0.013%, S: 0.013–0.019% and Cu: 0.03% or less, wherein said inner tube has a tensile strength of 40 $Kg/mm^2$ or over, and wherein said outer tube has a tensile strength lower than that of said inner tube.

4. A stave cooling device according to claim 1, wherein said alumina coating is formed by spraying alumina.

* * * * *

UNITED STATES PATENT AND TRADEMARK OFFICE

CERTIFICATE OF CORRECTION

PATENT NO. : 4,327,899

DATED : May 4, 1982

INVENTOR(S) : Gyoichi SUZUKI et al

It is certified that error appears in the above—identified patent and that said Letters Patent is hereby corrected as shown below:

On the title page, correct the priority application number as follows:

-- Apr. 9, 1979 [JP] Japan ..... 54-41926 ---.

Signed and Sealed this

First Day of March 1983

[SEAL]

*Attest:*

GERALD J. MOSSINGHOFF

*Attesting Officer*

*Commissioner of Patents and Trademarks*